US010087854B2

(12) United States Patent
Kim

(10) Patent No.: US 10,087,854 B2
(45) Date of Patent: Oct. 2, 2018

(54) CONTINUOUS VARIABLE DURATION SYSTEM AND ENGINE PROVIDED WITH THE SAME

(71) Applicant: Hyundai Motor Company, Seoul (KR)

(72) Inventor: Kyung Mo Kim, Hwaseong-si (KR)

(73) Assignee: Hyundai Motor Company, Seoul (KR)

( * ) Notice: Subject to any disclaimer, the term of this patent is extended or adjusted under 35 U.S.C. 154(b) by 64 days.

(21) Appl. No.: 15/379,087

(22) Filed: Dec. 14, 2016

(65) Prior Publication Data

US 2018/0100443 A1 Apr. 12, 2018

(30) Foreign Application Priority Data

Oct. 10, 2016 (KR) ..... 10-2016-0130653

(51) Int. Cl.

| | |
|---|---|
| ***F02D 13/02*** | (2006.01) |
| ***F01L 13/00*** | (2006.01) |
| ***F01L 1/26*** | (2006.01) |
| ***F01L 1/053*** | (2006.01) |
| ***F01L 1/18*** | (2006.01) |

(52) U.S. Cl.

CPC ..... *F02D 13/0207* (2013.01); *F01L 1/053* (2013.01); *F01L 1/181* (2013.01); *F01L 1/267* (2013.01); *F01L 13/0015* (2013.01); *F01L 13/0026* (2013.01); *F01L 2001/0535* (2013.01)

(58) Field of Classification Search

CPC ... F02D 13/0207; F01L 13/0015; F01L 1/053; F01L 1/181; F01L 2001/0535; F01L 13/0026; F01L 1/267

USPC ..... 123/90.15–90.17

See application file for complete search history.

(56) References Cited

U.S. PATENT DOCUMENTS

| | | | | |
|---|---|---|---|---|
| 2002/0023603 | A1* | 2/2002 | Nohara | F01L 1/3442 123/90.15 |
| 2013/0146006 | A1* | 6/2013 | Kim | F01L 1/0532 123/90.17 |
| 2017/0081989 | A1 | 3/2017 | Kim et al. | |
| 2017/0167320 | A1 | 6/2017 | Son et al. | |

FOREIGN PATENT DOCUMENTS

| | | |
|---|---|---|
| KR | 101628143 B1 | 6/2016 |
| KR | 101655232 B1 | 9/2016 |

* cited by examiner

*Primary Examiner* — Mark Laurenzi
*Assistant Examiner* — Wesley Harris
(74) *Attorney, Agent, or Firm* — Slater Matsil, LLP

(57) ABSTRACT

A continuous variable valve duration system may include a camshaft, and a first cam portion including a first cam. The camshaft is inserted in the first cam portion. A relative phase angle of the first cam with respect to the camshaft is variable. The system may further include an inner bracket transmitting rotation of the cam shaft to the first cam portion, a slider housing in which the inner bracket is rotatably inserted and movable along a predetermined first direction, a rocker shaft, a first rocker arm rotatably disposed to the rocker shaft of which a first end contacts with the first cam and of which a second end is connected to a first valve, an upper housing connected with the slider housing and relatively movable with respect to the slider housing along a second direction vertical to the first direction and a control portion selectively moving the upper housing.

18 Claims, 14 Drawing Sheets

CONTINUOUS VARIABLE DURATION SYSTEM AND ENGINE PROVIDED WITH THE SAME

CROSS-REFERENCE TO RELATED APPLICATIONS

This application claims priority to and the benefit of Korean Patent Application No. 10-2016-0130653 filed in the Korean Intellectual Property Office on Oct. 10, 2016, the entire contents of which are incorporated herein by reference.

TECHNICAL FIELD

The present invention relates to a continuous variable valve duration system and an engine provided with the same.

BACKGROUND

An internal combustion engine generates power by burning fuel in a combustion chamber in an air media drawn into the chamber. Intake valves are operated by a camshaft in order to intake the air, and the air is drawn into the combustion chamber while the intake valves are open. In addition, exhaust valves are operated by the camshaft, and a combustion gas is exhausted from the combustion chamber while the exhaust valves are open.

Optimal operation of the intake valves and the exhaust valves depends on a rotation speed of the engine. That is, an optimal lift or optimal opening/closing timing of the valves depends on the rotation speed of the engine. In order to achieve such optimal valve operation depending on the rotation speed of the engine, various researches, such as designing of a plurality of cams and a continuous variable valve lift (CVVL) that can change valve lift according to engine speed, have been undertaken.

Also, in order to achieve such an optimal valve operation depending on the rotation speed of the engine, research has been undertaken on a continuously variable valve timing (CVVT) apparatus that enables different valve timing operations depending on the engine speed. The general CVVT may change valve timing with a fixed valve opening duration.

However, the general CVVL and CVVT are complicated in construction and are expensive in manufacturing cost.

The above information disclosed in this Background section is only for enhancement of understanding of the background of the invention and therefore it may contain information that does not form the prior art that is already known in this country to a person of ordinary skill in the art.

SUMMARY

Various aspects of the present invention are directly providing a continuous variable valve duration system and an engine provided with the same which may vary opening duration of a valve according to operation conditions of an engine, with a simple construction.

A continuous variable valve duration system according to various aspects of the present invention may be applied to an SOHC engine so as to reduce weight of the engine and driving resistance.

A continuous variable valve duration system according to an exemplary embodiment of the present invention may include a camshaft, a first cam portion including a first cam, of which the camshaft is inserted therein and of which relative phase angle of the first cam with respect to the camshaft is variable, an inner bracket transmitting rotation of the cam shaft to the first cam portion, a slider housing in which the inner bracket is rotatably inserted and movable along a predetermined first direction, a rocker shaft, a first rocker arm rotatably disposed to the rocker shaft of which a first end contacts with the first cam and of which a second end is connected to a first valve, an upper housing connected with the slider housing and relatively movable with respect to the slider housing along a second direction vertical to the first direction and a control portion selectively moving the upper housing.

A control slot may be formed to the upper housing, wherein the control portion may include a control shaft and an eccentric shaft inserted into the control slot and eccentrically formed to the control shaft.

A slider housing connecting slot may be formed to the slider housing, an upper housing connecting slot may be formed to the upper housing, wherein a connecting shaft may be inserted into the slider housing connecting slot and the upper housing connecting slot such that the upper housing is relatively movable along the second direction with respect to the slider housing.

A guide hole may be formed to the slider housing and a guide shaft may be formed to the first direction and inserted into the guide hole for guiding movement of the slider housing.

A first and a second slot may be formed to the inner bracket, a first slider pin may be slidably connected with the camshaft and rotatably inserted into the first slot and a second slider pin on which a pin slot is formed may be rotatably inserted into the second slot.

The first slider pin may include a pin body slidably connected to the camshaft along a length direction thereof and a pin head inserted into the first slot.

The first cam portion may further include an outer shaft on which a wheel key inserted into the pin slot is formed and of which the camshaft is inserted, wherein the first cam may be connected to the outer shaft.

The continuous variable valve duration system may further include a first bridge connected to the second end of the first rocker arm, wherein two first valves may be connected to the first bridge.

The continuous variable valve duration system may further include a second cam portion including a second cam rotating with the camshaft and a second rocker arm rotatably connected to the rocker shaft, of which a first end contacts with the second cam and of which a second end is connected with a second valve.

The continuous variable valve duration system may further include a second bridge connected to the second end of the second rocker arm, wherein two second valves may be connected to the second bridge.

The first cam portion may further include an outer shaft on which a wheel key inserted into the pin slot is formed, of which the camshaft is inserted and the outer shaft on which guide slot is formed along a circumferential direction, wherein the first cam may be connected to the outer shaft.

The continuous variable valve duration system may further include a first bridge connected to the second end of the first rocker arm, wherein two first valves may be connected to the first bridge.

The continuous variable valve duration system may further include a second cam portion including a second cam connected with the camshaft through the guide slot and a second rocker arm rotatably connected to the rocker shaft, of which a first end contacts with the second cam and of which a second end is connected with a second valve.

The continuous variable valve duration system may further include a second bridge connected to the second end of the second rocker arm, wherein two second valves may be connected to the second bridge.

The continuous variable valve duration system may further include a support on which a control shaft supporting portion rotatably supporting the control shaft is formed.

A camshaft supporting portion rotatably supporting the camshaft may be formed to the support.

A rocker shaft supporting portion rotatably supporting the rocker shaft may be formed to the support.

As described above, a continuous variable valve duration system according to an exemplary embodiment of the present invention may vary an opening duration of a valve according to operation conditions of an engine, with a simple construction.

The continuous variable valve duration system according to an exemplary embodiment of the present invention may be reduced in size and thus the entire height of a valve train may be reduced.

Since the continuous variable valve duration system may be applied to an existing engine without excessive modification, thus productivity may be enhance and production cost may be reduced.

DETAILED DESCRIPTION OF ILLUSTRATIVE EMBODIMENTS

Figure 1:
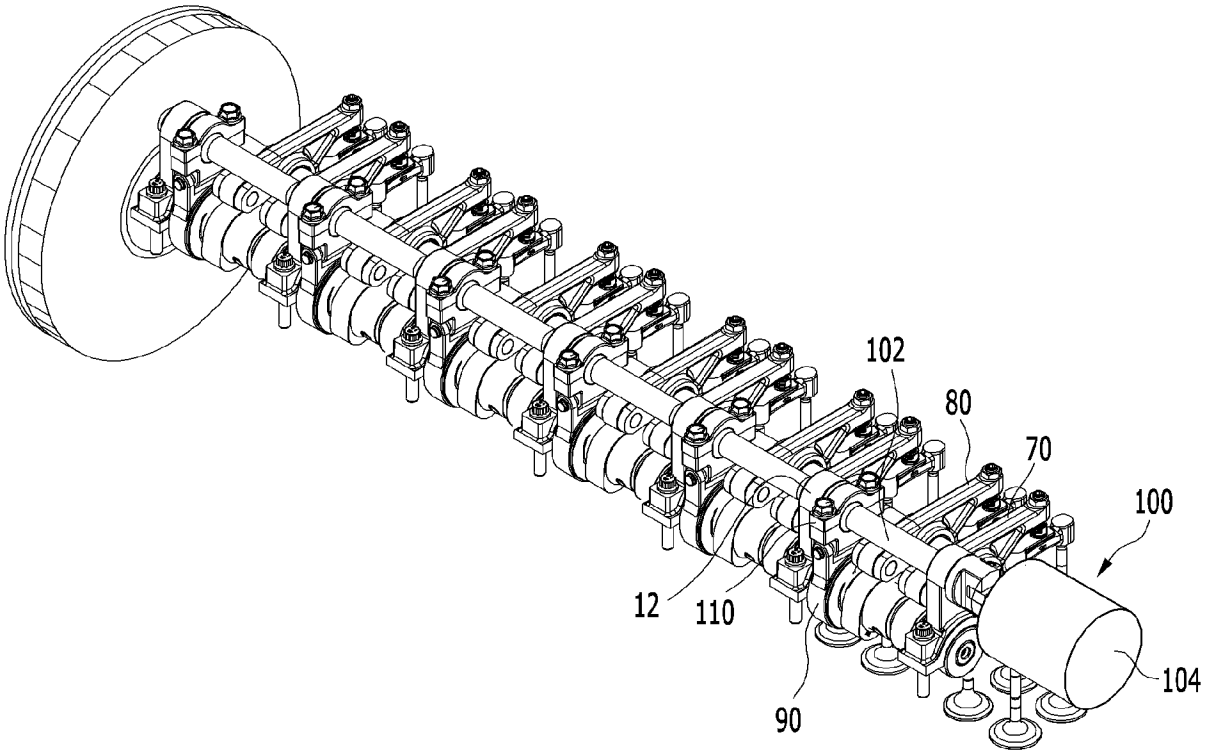
FIG. 1 is a perspective view of an engine provided with a continuous variable valve duration system according to an exemplary embodiment of the present invention.

In the following detailed description, only certain exemplary embodiments of the present invention have been shown and described, simply by way of illustration.

As those skilled in the art would realize, the described embodiments may be modified in various different ways, all without departing from the spirit or scope of the present invention A part irrelevant to the description will be omitted to clearly describe the present invention, and the same or similar elements will be designated by the same reference numerals throughout the specification.

In the drawings, the thickness of layers, films, panels, regions, etc., are exaggerated for clarity.

Throughout the specification and the claims, unless explicitly described to the contrary, the word "comprise" and variations such as "comprises" or "comprising", will be understood to imply the inclusion of stated elements but not the exclusion of any other elements.

An exemplary embodiment of the present invention will hereinafter be described in detail with reference to the accompanying drawings.

Figure 2:
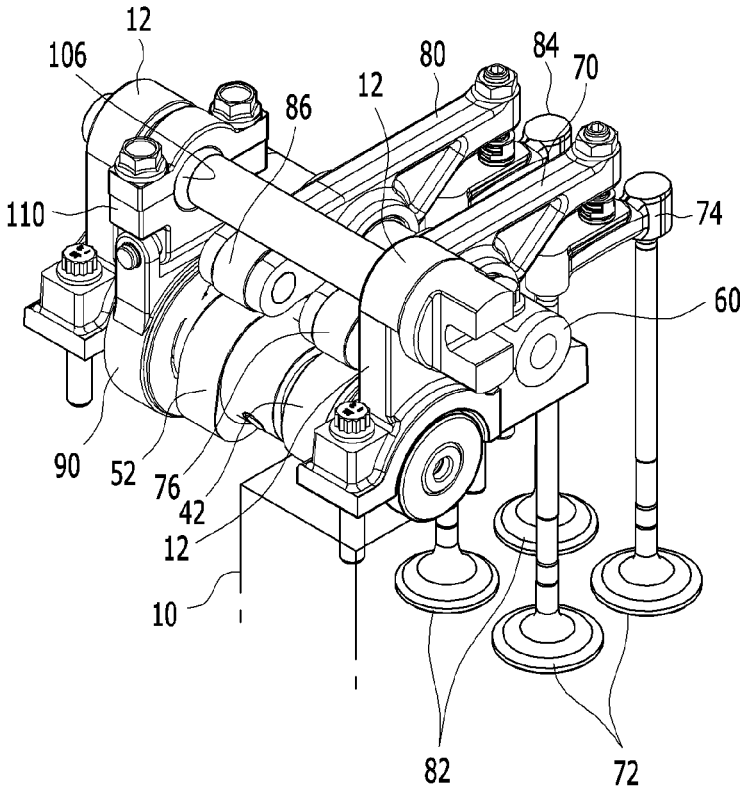
FIG. 2 is partial perspective view of a continuous variable valve duration system according to an exemplary embodiment of the present invention.

FIG. 1 is a perspective view of an engine provided with a continuous variable valve duration system according to an exemplary embodiment of the present invention and FIG. 2 is partial perspective view of a continuous variable valve duration system according to an exemplary embodiment of the present invention.

Figure 3:
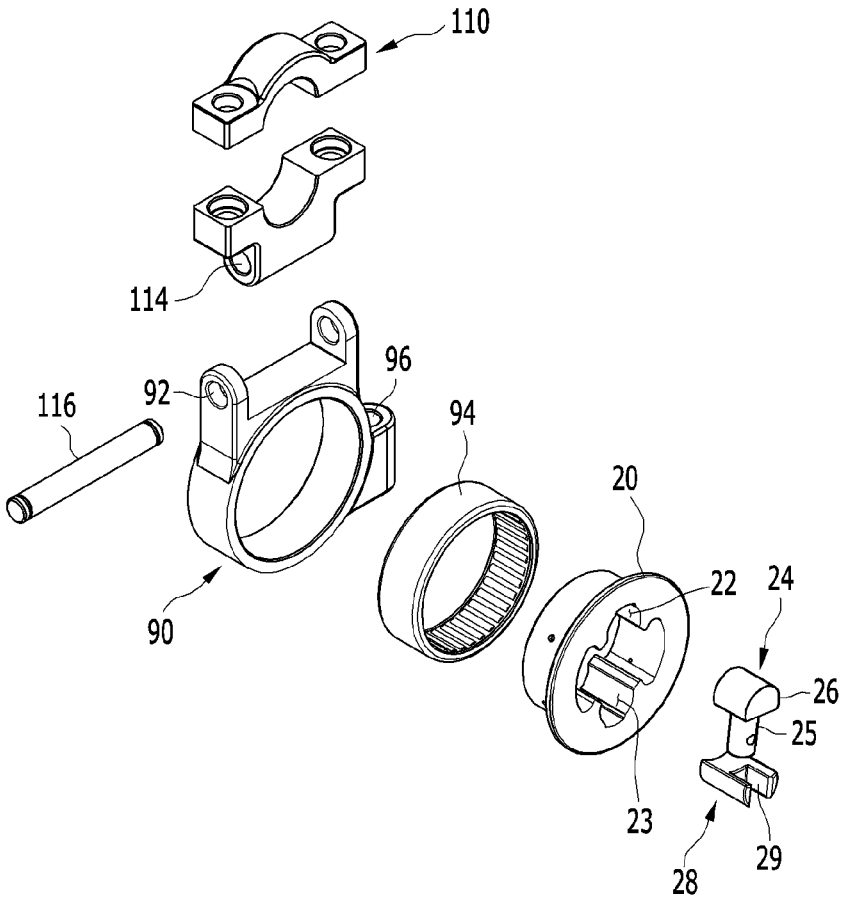
FIG. 3 is a partial exploded perspective view of a slider housing of a continuous variable valve duration system according to an exemplary embodiment of the present invention.
Figure 4:
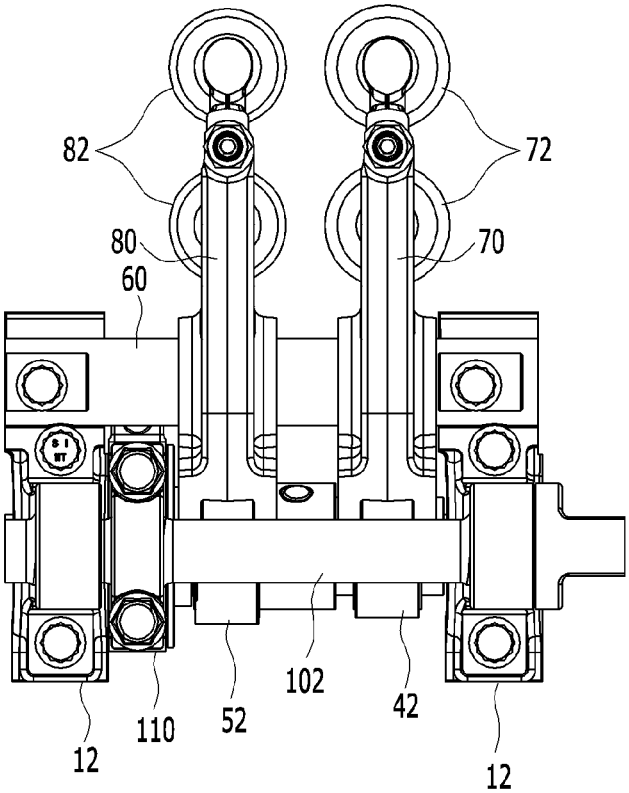
FIG. 4 is a top plan view of a continuous variable valve duration system according to an exemplary embodiment of the present invention.

FIG. 3 is a partial exploded perspective view of a slider housing of a continuous variable valve duration system according to an exemplary embodiment of the present invention and FIG. 4 is a top plan view of a continuous variable valve duration system according to an exemplary embodiment of the present invention.

Figure 5:
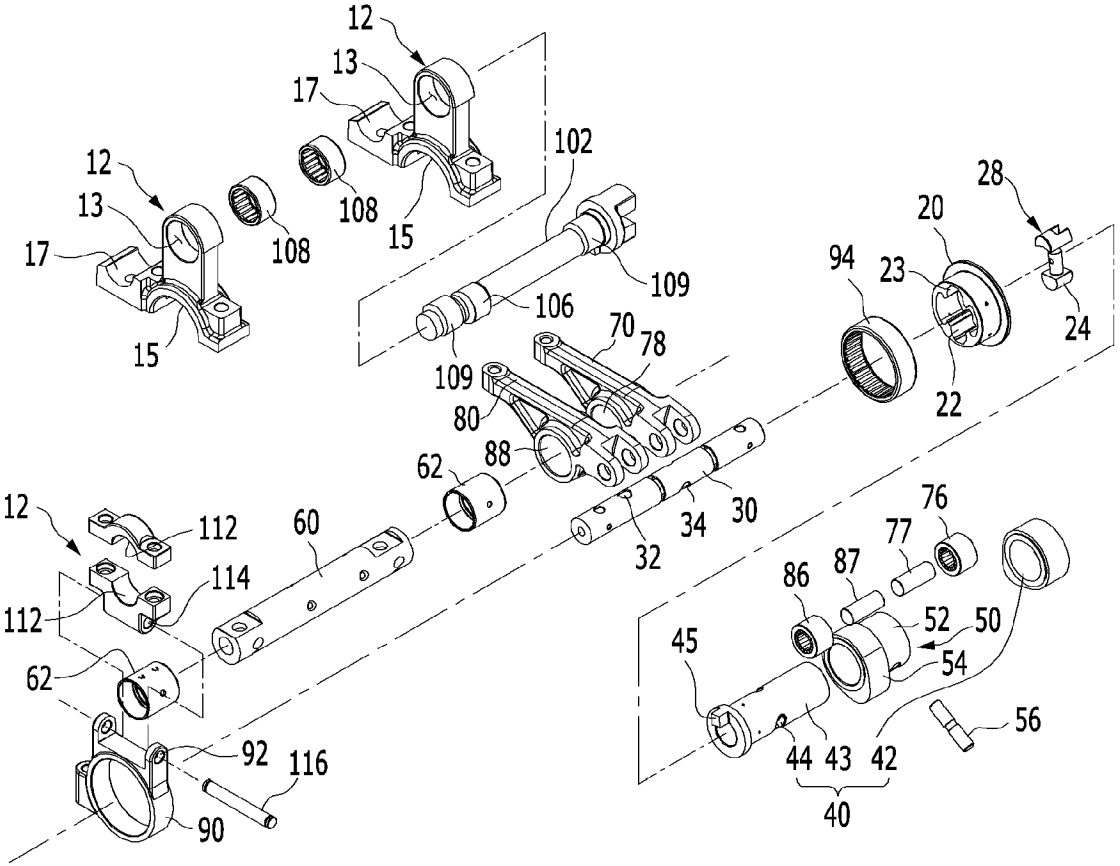
FIG. 5 is a partial exploded perspective view of a continuous variable valve duration system according to an exemplary embodiment of the present invention.
Figure 6:
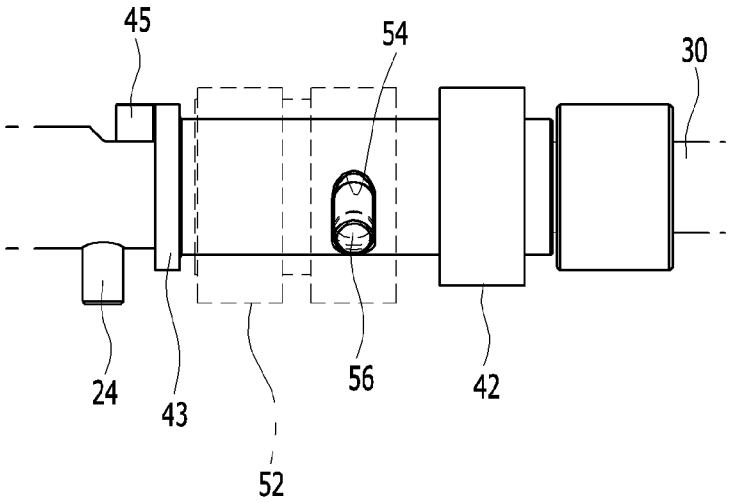
FIG. 6 is a drawing showing a first and a second cam portion of a continuous variable valve duration system according to an exemplary embodiment of the present invention.

FIG. 5 is a partial exploded perspective view of a continuous variable valve duration system according to an exemplary embodiment of the present invention and FIG. 6 is a drawing showing a first and a second cam portion of a continuous variable valve duration system according to an exemplary embodiment of the present invention.

Figure 7:
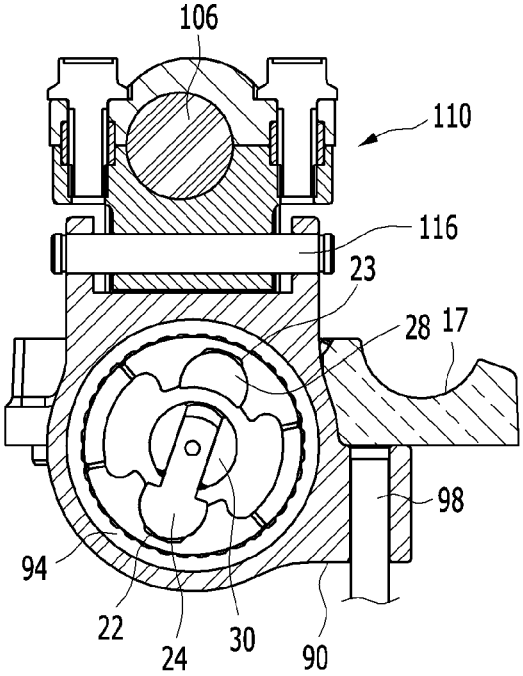
FIG. 7 and FIG. 8 are drawings showing operation of a continuous variable valve duration apparatus according to an exemplary embodiment of the present invention.
Figure 8:
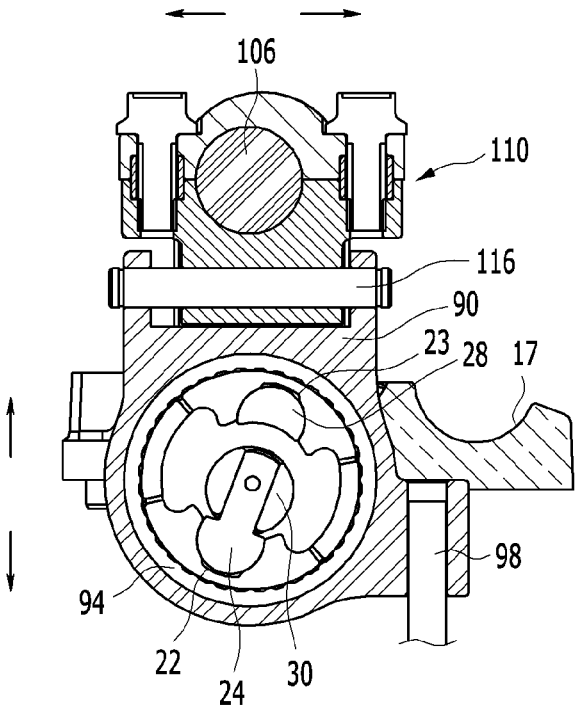

FIG. 7 and FIG. 8 are drawings showing operation of a continuous variable valve duration apparatus according to an exemplary embodiment of the present invention.

Referring to FIG. 1 to FIG. 8, a continuous variable valve duration system according to an exemplary embodiment of the present invention includes a camshaft 30, a first cam portion 40 including a first cam 42, of which the camshaft 30 is inserted therein and of which relative phase angle of the first cam 42 with respect to the camshaft 30 is variable, an inner bracket 20 transmitting rotation of the cam shaft 30 to the first cam portion 40, a slider housing 90 in which the inner bracket 20 is rotatably inserted and movable along a predetermined first direction, a rocker shaft 60, a first rocker arm 70 rotatably disposed to the rocker shaft 60 of which a first end contacts with the first cam 42 and of which a second end is connected to a first valve 72, an upper housing no connected with the slider housing 90 and relatively movable with respect to the slider housing 90 along a second direction vertical to the first direction and a control portion 100 selectively moving the upper housing no.

Referring to FIG. 8, the first direction is up/down direction of the drawing and the second direction is left/right direction of the drawings, but is not limited thereto.

In the drawings, it is shown as the upper housing no is divided into two elements and is assembled by engaging bolts and so on, but is not limited thereto.

A control slot 112 is formed to the upper housing no, and the control portion 100 includes a control shaft 102 and an eccentric shaft 106 inserted into the control slot 112 and eccentrically formed to the control shaft 102.

In FIG. 1, the control shaft 102 and the control motor 104 are directly conned with, but is not limited thereto. A worm gear and so on may be disposed between the control shaft 102 and the control motor 104 for reducing motor capacity.

The continuous variable valve duration system may further include a support 12 on which a control shaft supporting portion 13 rotatably supporting the control shaft 102 is formed and the support 12 may be connected to the engine or a cylinder head 10.

A bearing connecting portion 109 is formed to the control shaft 102 and a control shaft bearing 108 is interposed between the control shaft supporting portion 13 and the bearing connecting portion 109 for rotatably supporting the control shaft 102.

A camshaft supporting portion 15 rotatably supporting the camshaft 30 may be formed to the support 12 and a rocker shaft supporting portion 174 rotatably supporting the rocker shaft 60 may be formed to the support 12.

Since the camshaft supporting portion 15 and/or the rocker shaft supporting portion 17 are formed to the support 12, element number may be reduced and lay out of the entire system may be simplified.

A slider housing connecting slot 92 is formed to the slider housing 90, an upper housing connecting slot 114 is formed to the upper housing no, and a connecting shaft 116 is inserted into the slider housing connecting slot 92 and the upper housing connecting slot 114 such that the upper housing no is relatively movable along the second direction with respect to the slider housing 90.

A guide hole 96 is formed to the slider housing 90 and a guide shaft 98 is formed to the first direction and inserted into the guide hole 96 for guiding movement of the slider housing 90. The guide shaft 98 may be connected to the cylinder head 10.

A first and a second slot 22 and 23 is formed to the inner bracket 20.

A first slider pin 24 is slidably connected with the camshaft 30 and rotatably inserted into the first slot 22 and a second slider pin 28 on which a pin slot 29 is formed is rotatably inserted into the second slot 23.

The first slider pin 24 includes a pin body 25 slidably connected to the camshaft 30 along a length direction thereof and a pin head 26 inserted into the first slot 22, a camshaft hole 32 is formed to the camshaft 30 and the pin body 25 is slidably inserted into the camshaft hole 32.

The first cam portion 40 further includes an outer shaft 43 on which a wheel key 45 inserted into the pin slot 29 is formed and of which the camshaft 30 is inserted, and the first cam 42 is connected to the outer shaft 43.

A first roller 76 contacting the first cam 42 is connected to the first end of the first rocker arm 70 and the first roller 76 is connected to the first bridge 74 through a roller pin 77.

A first bridge 74 is connected to the second end of the first rocker arm 70 and two first valves 72 is connected to the first bridge 74.

The continuous variable valve duration system further includes a second cam portion 50 including a second cam 52 rotating with the camshaft 30 and a second rocker arm 80 rotatably connected to the rocker shaft 60, of which a first end contacts with the second cam 52 and of which a second end is connected with a second valve 82.

A second roller 86 contacting the second cam 52 is connected to the first end of the second rocker arm 80 and the second roller 86 is connected to the second bridge 84 through a roller pin 87.

A second bridge 84 is connected to the second end of the second rocker arm 80 and two second valves 82 may be connected to the second bridge 80.

A first rocker arm hole 78 is formed to the first rocker arm 70, a second rocker arm hole 88 is formed to the second rocker arm 80 and the rocker shaft 60 is inserted into the first rocker arm hole 78 and the second rocker arm hole 88. And a rocker shaft bearing 62 is interposed between the rocker shaft 60 and the first and the second rocker arm hole 78 and 88 respectively.

A guide slot 44 is formed to the outer shaft 43 along circumferential direction and the second cam portion 55 is connected with the camshaft 30 through the guide slot 44.

A cam connecting hole 34 is formed to the camshaft 30, a cam hole 54 is formed to the second cam portion 50, a cam connecting pin 56 is inserted into the cam connecting hole 34 and the cam hole 54 and the guide slot 44 guides relative rotation of the cam connecting pin 56.

Figure 9:
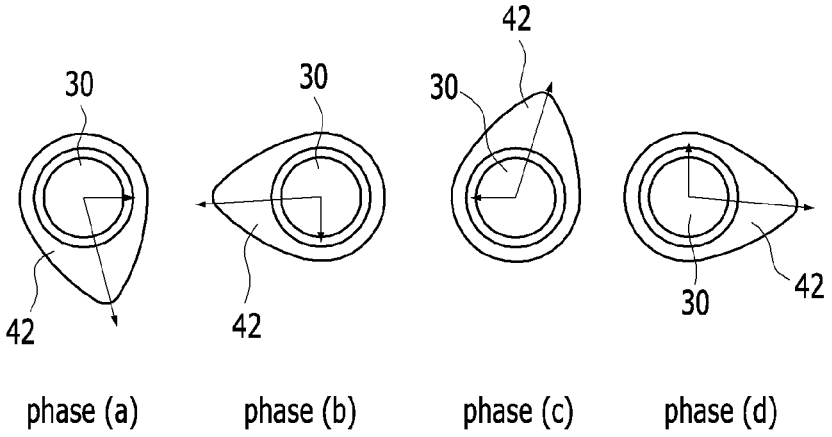
FIG. 9 and FIG. 10 are drawings showing mechanical motions of cams of a continuous variable valve duration apparatus according to an exemplary embodiment of the present invention.
Figure 10:
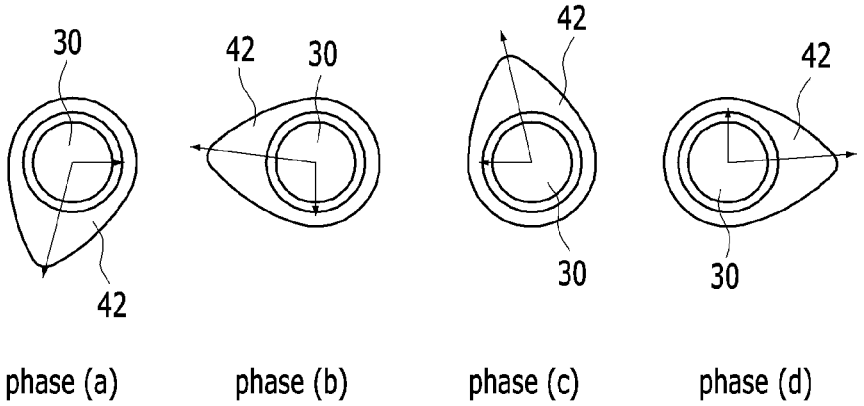

FIG. 9 and FIG. 10 are drawings showing mechanical motions of cams of a continuous variable valve duration apparatus according to an exemplary embodiment of the present invention.

Referring to FIG. 1 to FIG. 10, operations of the continuous variable valve duration system according to various aspects of the present invention will be discussed.

As shown in FIG. 7, in the case that rotation centers of the camshaft 30 and the inner bracket 20 are coincident, the first cam 42 rotates with the same phase angle of the camshaft 30.

As shown in FIG. 8, when the control portion 100 is operated and the upper housing 110 connected with the eccentric shaft 106 moves along the first direction and the second direction, the slider housing 90 connected with the upper housing 110 through the connecting shaft 116 moves along the first direction.

When the rotation centers of the camshaft 30 and the inner bracket 20 are not coincident according to operation of the control portion 100, rotation speed of the first cam 42 with respect to rotation speed of the camshaft 30 is changed.

That is, since the first slider pin 24 is slidable along length direction thereof with respect to the camshaft 30, the pin head 26 is rotatable within the first slot 22, the second slider pin 28 is rotatable within the second slot 23, and the wheel key 45 is slidable within the pin slot 29, such that the rotation speed of the first cam 42 with respect to the rotation speed of the camshaft 30 is changed when the rotation centers of the camshaft 30 and the inner bracket 20 are not coincident.

When the rotation center of the inner bracket 20 with respect to the camshaft 30 moves downward, the rotation speed of the first cam 42 is relatively faster than rotation speed of the camshaft 30 from phase a to phase b and from phase b to phase c, then the rotation speed of the first cam 42 is relatively slower than rotation speed of the camshaft 30 from phase c to phase d and from phase d to phase a as shown in FIG. 9.

When the rotation center of the inner bracket 20 with respect to the camshaft 30 moves upward according to the operation of the control portion 100, the rotation speed of the first cam 42 is relatively slower than rotation speed of the camshaft 30 from phase a to phase b and from phase b to phase c, then the rotation speed of the first cam 42 is relatively faster than rotation speed of the camshaft 30 from phase c to phase d and from phase d to phase a as shown in FIG. 10.

According to the relative position of the inner bracket 20, timing of the first cam 42 to push the first roller 76 that is the timing of the first valve 72 is opened or closed is changed.

FIG. 11 to FIG. 14 are graphs of a valve profile of a continuous variable valve duration apparatus according to an exemplary embodiment of the present invention.

The continuous variable valve duration system according to an exemplary embodiment of the present invention may perform various valve profiles according to contacting positions of the first cam 42 and the first roller 76, mounting angle of the first cam 42 and the first roller 76 and so on.

Figure 11:
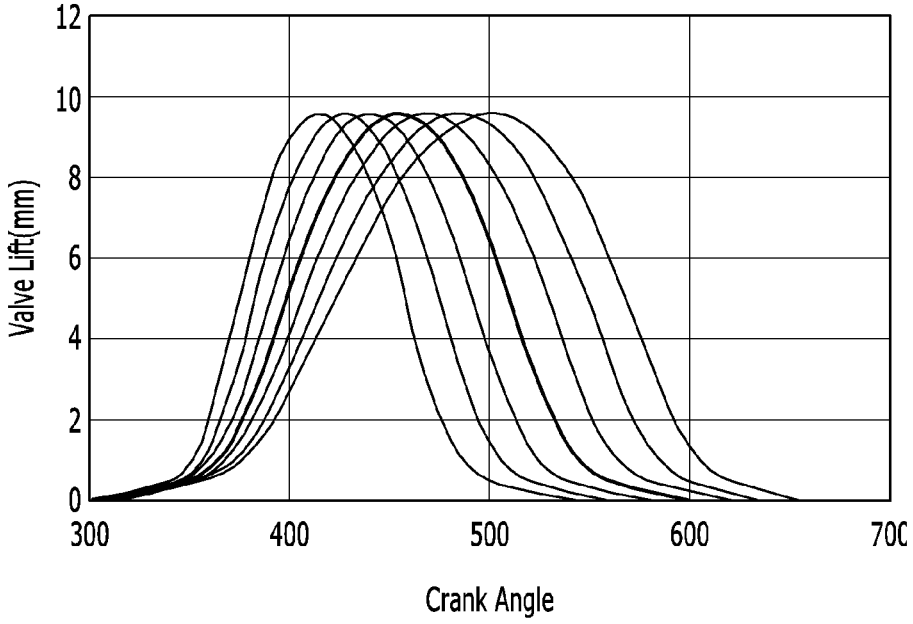
FIG. 11 to FIG. 14 are graphs of a valve profile of a continuous variable valve duration apparatus according to an exemplary embodiment of the present invention.
Figure 12:
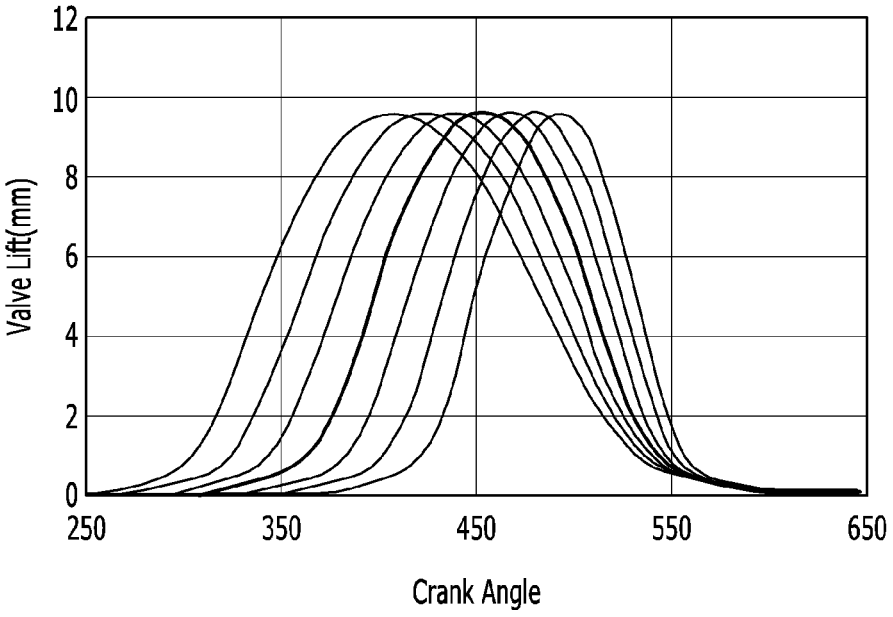

As shown in FIG. 11, opening time of the first valve 72 may be fixed while closing time of the first valve 72 is changed. Or the opening time of the first valve 72 may be changed while the closing time of the first valve 72 is fixed as shown in FIG. 12.

Figure 13:
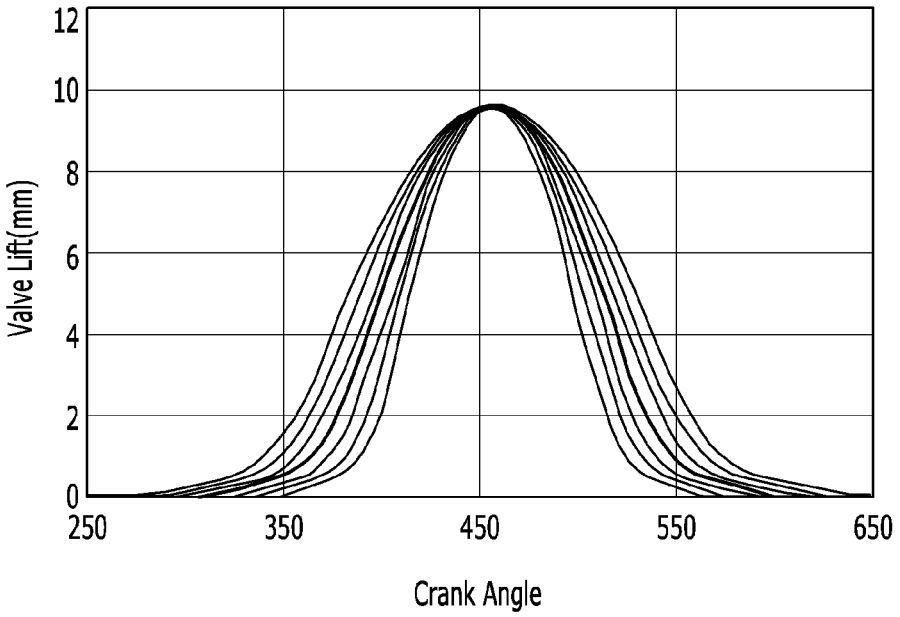
Figure 14:
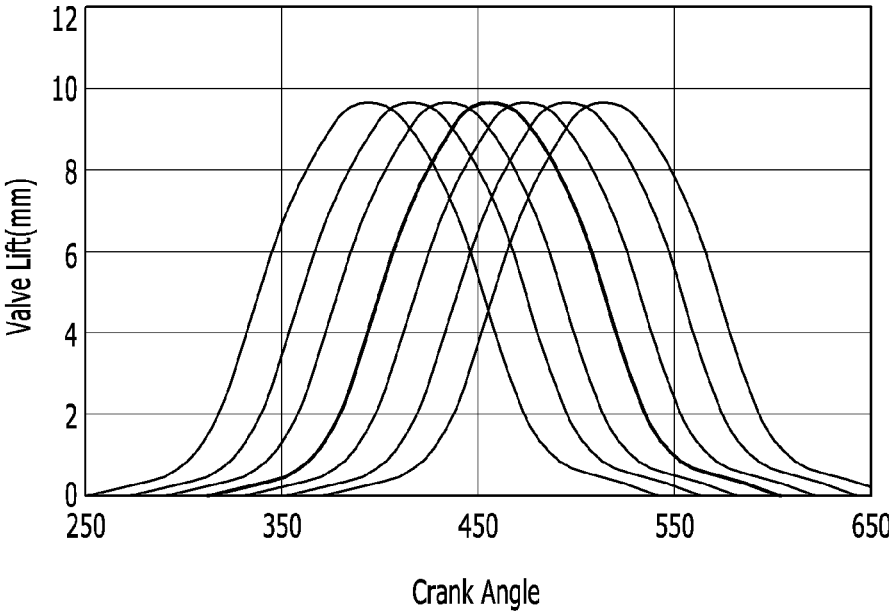

As shown in FIG. 13, peak time of the first valve 72 may be fixed while duration of the first valve 72 is changed. Or closing time and opening time of the first valve 72 simultaneously changed as shown in FIG. 14.

As described above, a continuous variable valve duration system according to an exemplary embodiment of the present invention may vary an opening duration of a valve according to operation conditions of an engine, with a simple construction.

The continuous variable valve duration system according to an exemplary embodiment of the present invention may be reduced in size and thus the entire height of a valve train may be reduced.

Since the continuous variable valve duration system may be applied to an existing engine without excessive modification, thus productivity may be enhance and production cost may be reduced.

While this invention has been described in connection with what is presently considered to be practical exemplary embodiments, it is to be understood that the invention is not limited to the disclosed embodiments. On the contrary, it is intended to cover various modifications and equivalent arrangements included within the spirit and scope of the appended claims.

What is claimed is:

1. A continuous variable valve duration system comprising:

a camshaft;

a first cam portion including a first cam, wherein the camshaft is inserted in the first cam portion, and wherein a relative phase angle of the first cam with respect to the camshaft is variable;

an inner bracket transmitting rotation of the camshaft to the first cam portion;

a slider housing in which the inner bracket is rotatably inserted and movable along a predetermined first direction;

a rocker shaft;

a first rocker arm rotatably disposed to the rocker shaft, a first end of the first rocker arm contacting with the first cam and a second end of the first rocker arm being connected to a first valve;

an upper housing connected with the slider housing and relatively movable with respect to the slider housing along a second direction perpendicular to the first direction; and a control portion selectively moving the upper housing.

2. The continuous variable valve duration system of claim 1, wherein a control slot is formed to the upper housing; and wherein the control portion comprises a control shaft, and an eccentric shaft inserted into the control slot and eccentrically formed to the control shaft.

3. The continuous variable valve duration system of claim 2, wherein a slider housing connecting slot is formed to the slider housing, wherein an upper housing connecting slot is formed to the upper housing, wherein a connecting shaft is inserted into the slider housing connecting slot and the upper housing connecting slot, wherein the upper housing is relatively movable along the second direction with respect to the slider housing.

4. The continuous variable valve duration system of claim 2, wherein a guide hole is formed to the slider housing, and wherein a guide shaft is formed to the first direction and inserted into the guide hole for guiding movement of the slider housing.

5. A continuous variable valve duration system comprising:

a camshaft;

a first cam portion including a first cam, wherein the camshaft is inserted in the first cam portion, and wherein a relative phase angle of the first cam with respect to the camshaft is variable;

an inner bracket transmitting rotation of the camshaft to the first cam portion;

a slider housing in which the inner bracket is rotatably inserted and movable along a predetermined first direction;

a rocker shaft;

a first rocker arm rotatably disposed to the rocker shaft, a first end of the first rocker arm contacting with the first cam and a second end of the first rocker arm being connected to a first valve;

an upper housing connected with the slider housing and relatively movable with respect to the slider housing along a second direction perpendicular to the first direction; and a control portion selectively moving the upper housing, wherein the inner bracket comprises a first slot and a second slot;

wherein a first slider pin is slidably connected with the camshaft and rotatably inserted into the first slot; and wherein a second slider pin on which a pin slot is formed is rotatably inserted into the second slot.

6. The continuous variable valve duration system of claim 5, wherein the first slider pin comprises:

a pin body slidably connected to the camshaft along a length direction thereof; and a pin head inserted into the first slot.

7. The continuous variable valve duration system of claim 5, wherein the first cam portion further comprises an outer shaft on which a wheel key inserted into the pin slot is formed and wherein the camshaft is inserted into the outer shaft, wherein the first cam is connected to the outer shaft.

8. The continuous variable valve duration system of claim 7, further comprising a first bridge connected to the second end of the first rocker arm, wherein two first valves are connected to the first bridge.

9. The continuous variable valve duration system of claim 7, further comprising:

a second cam portion including a second cam rotating with the camshaft; and a second rocker arm rotatably connected to the rocker shaft, a first end of the second rocker arm contacting with the second cam and a second end of the second rocker arm being connected with a second valve.

10. The continuous variable valve duration system of claim 9, further comprising a second bridge connected to the second end of the second rocker arm, wherein two second valves are connected to the second bridge.

11. The continuous variable valve duration system of claim 5, wherein the first cam portion further comprises an outer shaft on which a wheel key inserted into the pin slot is formed, wherein the camshaft is inserted into the outer shaft, and the outer shaft on which guide slot is formed along a circumferential direction, wherein the first cam is connected to the outer shaft.

12. The continuous variable valve duration system of claim 11, further comprising a first bridge connected to the second end of the first rocker arm, wherein two first valves are connected to the first bridge.

13. The continuous variable valve duration system of claim 11, further comprising:

a second cam portion including a second cam connected with the camshaft through the guide slot; and a second rocker arm rotatably connected to the rocker shaft, of which a first end contacts with the second cam and of which a second end is connected with a second valve.

14. The continuous variable valve duration system of claim 13, further comprising a second bridge connected to the second end of the second rocker arm, wherein two second valves are connected to the second bridge.

15. A continuous variable valve duration system comprising:

a camshaft;

a first cam portion including a first cam, wherein the camshaft is inserted in the first cam portion, and wherein a relative phase angle of the first cam with respect to the camshaft is variable;

an inner bracket transmitting rotation of the camshaft to the first cam portion;

a slider housing in which the inner bracket is rotatably inserted and movable along a predetermined first direction;

a rocker shaft;

a first rocker arm rotatably disposed to the rocker shaft, a first end of the first rocker arm contacting with the first cam and a second end of the first rocker arm being connected to a first valve;

an upper housing connected with the slider housing and relatively movable with respect to the slider housing along a second direction perpendicular to the first direction; and a control portion selectively moving the upper housing, and comprising a control shaft; and a support rotatably supporting the control shaft.

16. The continuous variable valve duration system of claim 15, wherein a camshaft supporting portion rotatably supporting the camshaft is formed to the support.

17. The continuous variable valve duration system of claim 15, wherein a rocker shaft supporting portion rotatably supporting the rocker shaft is formed to the support.

18. The continuous variable valve duration system of claim 15, wherein a control slot is formed to the upper housing; and wherein the control portion comprises the control shaft, and an eccentric shaft inserted into the control slot and eccentrically formed to the control shaft.

* * * * *